US005762490A

United States Patent [19]

Rodgers

[11] Patent Number: 5,762,490

[45] Date of Patent: Jun. 9, 1998

[54] PREMIXED GAS BURNER ORIFICE

[75] Inventor: Ian M. Rodgers, Ooltewah, Tenn.

[73] Assignee: Burner Systems International, Inc., Chattanooga, Tenn.

[21] Appl. No.: 878,722

[22] Filed: Jun. 19, 1997

[51] Int. Cl.[6] ..... F23D 14/62

[52] U.S. Cl. ..... 431/354; 48/180.1

[58] Field of Search ..... 431/354; 48/180.1, 48/186

[56] References Cited

U.S. PATENT DOCUMENTS 734,087 7/1903 Patric ..... 48/180.1

FOREIGN PATENT DOCUMENTS

236157 A1 5/1986 Germany ..... 431/354

54-162238 12/1979 Japan ..... 431/344

*Primary Examiner*—Carroll B. Dority

*Attorney, Agent, or Firm*—Alan Ruderman

[57] ABSTRACT

A premixed gas burner for use in a boiler or the like has a burner body including a distribution tube into which air under pressure and a gas fuel are received. The gas is supplied to the distribution tube through a gas supply orifice tube having a flange in the form of a disk disposed about the periphery of the gas supply tube and positioned a short distance within the distribution tube. The gas supply tube has a number of orifices located about the tube adjacent to the downstream facing surface of the flange. The distribution tube is located within a pressurized air chamber and gas supplied from a manifold to the supply tube is mixed turbulently adjacent the downstream face of the flange. The invention extends the operating range of premixed gas burners and reduces the carbon monoxide and $NO_x$ output of the burner.

14 Claims, 1 Drawing Sheet

PREMIXED GAS BURNER ORIFICE

BACKGROUND OF THE INVENTION

This invention relates to gas burners wherein the gas and air are premixed in a burner tube, and more particularly to the gas orifice feeding the gas to the burner tube. The orifice acting to improve mixing.

Premixed gas burners used in boilers and other applications provide a high heat release in a small area while providing low pollutant gas combustion product emissions. Generally such premixed gas burners comprise a hollow body having a closed end and an open end, the open end including a distribution tube or venturi tube into which the premixed gas flows. The gas and air are forced through the burner and the gas is burned with excess air so as to provide cleaner combustion products. The gas is supplied through an orifice tube comprising a cylindrical member having an inlet connected to the gas manifold and an outlet in the form of a small central opening in the face, the opening facing into the inlet of the distribution tube. In the prior art difficulties are encountered stemming from a very narrow burner operating range. The pressure of the gas exiting a conventional orifice is equal to the difference between the pressure of the gas in the gas manifold minus pressure in the air chamber or air intake duct. Thus, as the air chamber pressure varies due to fluctuations in the pressure of the supply air e.g., the fan outlet, variations in the air to gas ratio result. As the air chamber pressure increases the gas input energy decreases and vice versa. This leads to a very narrow operating range as the flame tends to lift when the gas to air ratio is very lean causing carbon monoxide and nuisance shut downs. The burner tends to overheat when the gas to air ratio is rich, causing burner failure and potential fire hazards and explosion.

Therefore, in prior art systems there is a compounding effect—with high air pressure gas delivery is lower resulting in a lean mixture and with low air pressure gas delivery is higher resulting in a rich mixture. In both cases carbon monoxide levels increase and $NO_x$ (NO and $NO_2$) levels vary from very low when there is a lean mixture to very high when there is a rich mixture. The operating range is thus relatively limited. For a given gas manifold pressure the amount of carbon monoxide decreases as the chamber pressure increases to a certain point and thereafter again increases with increase in chamber pressure. In prior art systems, there is a very limited range of chamber pressure where carbon monoxide is at a minimum, rising rapidly both at lower chamber pressures and at higher chamber pressures.

SUMMARY OF THE INVENTION

Consequently, it is a primary object of the present invention to provide a premixed gas burner having a relatively wide range of operating chamber pressures and substantially improved energy input at higher air chamber pressure.

It is another object of the present invention to provide a premixed gas burner having a gas orifice for feeding gas fuel to be mixed with air supplied to the burner, the orifice providing substantially increased mixing of the gas and air.

It is a further object of the present invention to provide a premixed gas burner having a gas orifice that not only does not have a fall-off in energy input as air chamber pressure increases, but actually has an increase in energy input as air chamber pressure increases at least within a practical chamber pressure range.

It is a still further object of the present invention to provide a gas orifice tube for premixed gas burners wherein the gas exits the tube adjacent a flange upstream of the gas exit, the flange being disposed within the distribution tube of the burner.

It is a yet further object of the present invention to provide a gas orifice tube for premixed gas burners wherein the gas exits the tube radially adjacent a flange upstream of the gas exit, the flange being disposed within the distribution tube of the burner.

Accordingly, the present invention provides a premixed gas burner gas orifice having at least one gas metering outlet disposed downstream and adjacent to the face of a flange which is disposed within the burner distribution tube and which provides substantially improved mixing of the gas and air. In the preferred form of the invention there are several outlets disposed radially closely adjacent to the flange. Air, from the air chamber in which the burner is disposed, has a rapid and large change in velocity at the flange. This results in eddy currents at the downstream face of the flange, creating a swirling flow of air and gas thereby resulting in very good mixing of the gas and air. The diameter of the flange is slightly smaller than the diameter of the distribution tube and the structure creates a zone of zero pressure or even slightly negative pressure in the vicinity of the downstream face of the flange. This low pressure zone effectively eliminates or even reverses the conventional effects of upstream pressure fluctuations on the gas flow. Thus, increases in air chamber pressure results in increase in the energy input as the carbon monoxide and $NO_x$ levels decrease in the typical range of chamber pressures. Operating range of chamber pressures is extended substantially both at the low end and the high end without increasing the carbon monoxide and $NO_x$ levels. At the higher end of the range of chamber pressure, i.e., for leaner mixtures, the energy input is significantly higher than that obtained with prior art metering orifices.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
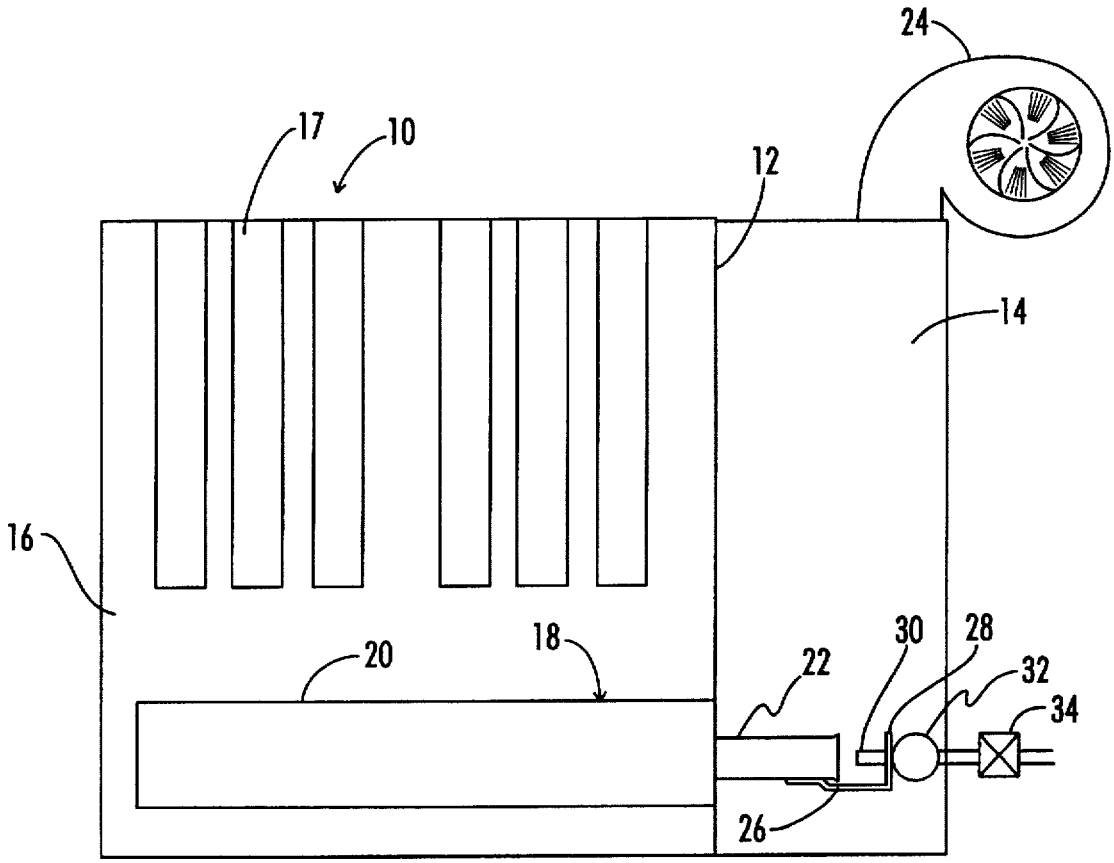
FIG. 1 PRIOR ART
FIG. 1 is a diagrammatic elevational view of a heater having at least one premixed gas burner including a prior art fuel orifice.

A premixed gas burner of the type comprising the present invention may be utilized in fan induced gas fired boilers or heaters and similar appliances. As illustrated in FIG. 1, a heater or the like 10 includes a wall 12 separating an air chamber 14 from the heating chamber 16. A heat exchanger having tubes 17 extending the length of the heater is disposed within the heating chamber 16 and is heated by the premixed burner 18. The burner 18 includes a burner body 20 within the heating chamber 16 and has a distribution tube or venturi tube 22 secured thereto at one end and disposed within the air chamber 14, the opposite end of the burner body 20 being closed. The free end of the distribution tube is open to permit air from the chamber 14 and gas fuel to enter and mix therein and to burn within the burner body as is well known in the art. Air under a positive pressure is supplied to the air chamber 14 by a blower or fan 24. Fastened to the distribution tube 22 is one leg 26 of a substantially L-shape bracket having its second leg 28 disposed in front of the open end of the tube 22. As illustrated in FIG. 1, a prior art gas orifice tube 30 is carried by the leg 28 of the bracket, the gas orifice tube 30 being a cylindrical member having an inlet threadedly connected into the gas manifold 32 which receives gas fuel from a supply through a valve 34. The gas from the manifold 32 flows through the cylindrical orifice member and out through a single small hole in the face of the orifice spaced from and facing the open end of the distribution tube 22.

As aforesaid, the conventional gas orifice 30 of the prior art provides a very limited or narrow operating range. As the pressure in the air chamber 14 varies due to fluctuations at the output of the fan 24, a pressure increase in the chamber would result in the pressure of the gas exiting the orifice 30 to be reduced relative to the gas pressure within the gas manifold 32. If the air pressure increased to equal that of the gas manifold pressure the mixture entering the burner would be exceptionally lean. If the air pressure in the chamber 14 decreases relative to its nominal value the pressure of the gas entering the burner would increase and a richer fuel mixture would result. This leads to a very narrow operating band since the flame tends to lift when the fuel/air mixture is lean and carbon monoxide in the combustion products increases. When the fuel/air mixture is rich, carbon monoxide and $NO_x$ increase and, additionally, burner overheating may occur. Moreover, as the air pressure increases the gas input (BTU per hour) decreases substantially and increases to undesirable levels when the air chamber pressure decreases. The air pressure operating range therefore must remain within a very narrow range to minimize the effects of increased carbon monoxide and $NO_x$ effects yet obtain reasonable energy input levels and secure reasonable burner life. Although a flatter energy input relative to chamber pressure may be obtained by controlling the valve 34 by means of the pressure in the air chamber 14, i.e., referencing the valve, this is a more expensive system since a pressure sensor and control elements are required. The valve which has a governing spring that acts in response to the manifold pressure minus the air chamber pressure limits the use of low manifold pressures because the governing spring needs a minimum pressure to operate effectively. Therefore, the minimum manifold pressure is equal to the minimum governing spring pressure plus the air chamber pressure. In the present invention the minimum manifold pressure can equal the minimum governing spring pressure.

Figure 2:
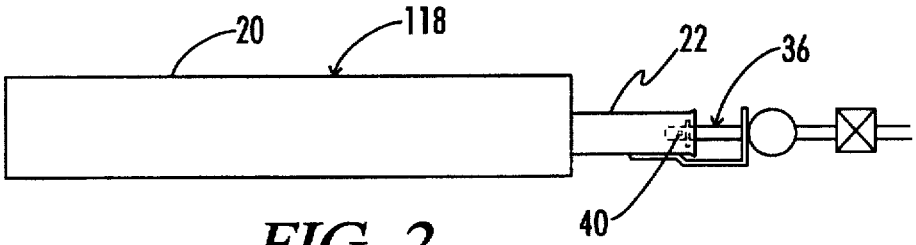
FIG. 2 is a fragmentary view of a portion of FIG. 1 illustrating a burner incorporating a fuel supply orifice constructed in accordance with the present invention.
Figure 3:
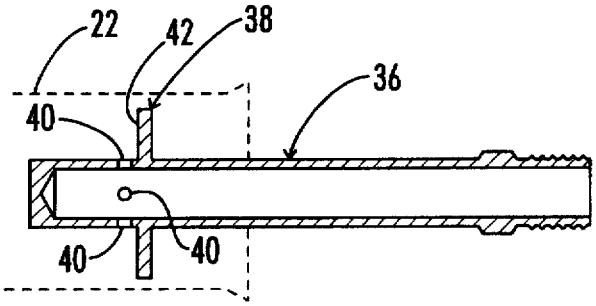
FIG. 3 is an enlarged cross sectional view taken through the fuel supply orifice illustrated in FIG. 2, and illustrating its disposition within the burner distribution tube.

Referring to FIGS. 2 and 3 a burner 118 incorporating the principles of the present invention incorporates a new orifice tube 36, the burner being substantially the same as the burner 18. Thus, the burner 118 may include a burner body 20 and distribution tube 22 identical to that of the prior art. The gas orifice tube 36, however, may be substantially elongated relative to the tube 30 of the prior art and includes a flange 38 in the form of a disk formed integral with or securely fastened as a separate member to the tube 36. The disk 38 preferably has a diameter slightly smaller than the internal diameter of the distribution tube 22 of the burner 18 and is disposed within the distribution tube slightly downstream from the air inlet, i.e., slightly within the distribution tube 22. For example, for a burner having a distribution tube including an internal diameter of approximately 1.25 inches, the diameter of the flange 38 may be in the order of approximately 1 inch.

Although a single orifice opening may be provided for in the end of the orifice tube 36 which is within the distribution tube, it is preferred that there be more than one such orifice or metering opening. In the preferred embodiment, as illustrated, four such orifices or metering openings 40 are provided spaced 90 degrees apart about the tube 36 adjacent to the downstream face 42 of the flange 38. In a prototype the openings 40 were approximately 0.060 inch in diameter spaced approximately 0.125 inch from the face 42 of the flange. Thus, the spacing of the orifices from the flange is approximately twice the diameter of the orifices. The flange 38 by limiting the area of flow for air from the chamber 14 into the distribution tube to the annular space between the flange and the distribution tube 22, results in a zone of zero pressure or even slightly negative pressure downstream of the face 42 of the flange 38. In the preferred embodiment this zero or negative pressure is in the vicinity of the orifices or metering holes 40 and effectively eliminates or even reverses the effects of upstream pressure fluctuations of the air on the gas flow. It is believed that a swirling of the mixture or eddy currents result adjacent to the downstream face 38.

By eliminating the effects of upstream pressure fluctuations on the gas flow, energy input increases with increasing air chamber pressure. It effectively provides a gas/air ratio control without expensive or elaborate controls such as negative regulating valves, modulating fans or referencing of the valve to the air chamber. Significantly, the invention shifts the operating characteristics of a burner to provide a larger operating range than that obtained in the prior art. Other advantages include maintaining the burner cooler under adverse operating conditions, prevention of gas leakage into the positively pressurized air chamber, effective control of the burning characteristics in relation to the air velocity rather than the air pressure in the chamber 14, and, significantly, increased mixing of the gas and air which appears to be the result of the swirling or eddy currents. A further significant advantage is that low manifold pressures may be utilized which, as aforesaid, may not be accomplished by the prior art orifice tube. The manifold pressure may be equal to the minimum effective governing spring pressure of the valve, i.e., the governing spring pressure may be the same as the manifold pressure.

Consequently, although the invention is simple in hindsight, it provides improved results for premixed gas burners that would not be expected. The carbon monoxide, $NO_x$ and carbon dioxide levels of the combustion products are relatively stable compared to the prior art over a large air chamber pressure range and in this range the energy input increases rather than decreases as in the prior art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a premixed gas burner comprising an elongated distribution tube defining a passageway therethrough having an inlet opening at one end for receiving air under pressure and an outlet opening at the other end communicating with a burner body within which gas fuel and air are burned, a gas supply tube for supplying gas fuel from a supply source to the distribution tube, an inperforate flange disposed about and extending radially from said gas supply tube and having an area slightly less than the internal area of said distribution tube, means for mounting said gas supply tube with said flange disposed within said distribution tube to define an annular space therebetween through which all air through said distribution tube passes, and at least one gas orifice formed in said gas supply tube downstream of said flange directed radially for communicating gas from the interior of said gas supply tube into said distribution tube for mixing with air downstream of said flange.

2. In a premixed gas burner as recited in claim 1, wherein said flange has a circular outer periphery and said distribution tube comprises a hollow cylindrical body.

3. In a premixed gas burner as recited in claim 1, wherein there are a plurality of gas orifices disposed on said tube.

4. In a premixed gas burner as recited in claim 3, wherein said flange has a circular outer periphery and said distribution tube comprises a hollow cylindrical body.

5. In a premixed gas burner as recited in claim 3, wherein said orifices are spaced at locations about the periphery of said tube.

6. In a premixed gas burner as recited in claim 5, wherein there are four orifices spaced substantially equally apart about the tube.

7. In a premixed gas burner as recited in claim 6, wherein said flange has a circular outer periphery and said distribution tube comprises a hollow cylindrical body.

8. In a premixed gas burner as recited in claim 1, wherein said at least one gas orifice is disposed closely adjacent to said flange in a low air pressure zone resulting from air flow through said annular space.

9. In a premixed gas burner as recited in claim 8, wherein there are a plurality of gas orifices disposed on said tube.

10. In a premixed gas burner as recited in claim 9, wherein said flange has a circular outer periphery and said distribution comprises a hollow cylindrical body.

11. In a premixed gas burner as recited in claim 9, wherein said orifices are spaced at locations about the periphery of said tube.

12. In a premixed gas burner as recited in claim 11, wherein there are four orifices spaced substantially equally apart about the tube.

13. In a premixed gas burner as recited in claim 12, wherein said flange has a circular outer periphery and said distribution tube comprises a hollow cylindrical body.

14. In a premixed gas burner as recited in claim 9, wherein said orifices are circular and are disposed a distance of approximately twice the diameter of the orifices from the flange.

* * * * *